US011248766B2

(12) United States Patent
Knaack et al.

(10) Patent No.: US 11,248,766 B2
(45) Date of Patent: Feb. 15, 2022

(54) HEADLIGHT FOR VEHICLES

(71) Applicant: HELLA GmbH & Co. KGaA, Lippstadt (DE)

(72) Inventors: Ulrich Knaack, Paderborn (DE); Piet Risthaus, Lippstadt (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/228,216

(22) Filed: Apr. 12, 2021

(65) Prior Publication Data

US 2021/0231281 A1 Jul. 29, 2021

Related U.S. Application Data

(63) Continuation of application No. PCT/EP2019/076612, filed on Oct. 1, 2019.

(30) Foreign Application Priority Data

Oct. 11, 2018 (DE) ..... 10 2018 125 157.2

(51) Int. Cl.
*F21S 41/265* (2018.01)
*F21W 102/14* (2018.01)
*F21S 41/24* (2018.01)

(52) U.S. Cl.
CPC ..... *F21S 41/265* (2018.01); *F21S 41/24* (2018.01); *F21W 2102/14* (2018.01)

(58) Field of Classification Search
CPC ..... F21S 41/24; F21S 41/25; F21S 41/265
See application file for complete search history.

(56) References Cited

U.S. PATENT DOCUMENTS 7,611,272 B2 11/2009 Specht et al.
8,801,242 B2 8/2014 Hamm et al.
(Continued)

FOREIGN PATENT DOCUMENTS

AT 510931 A1 7/2012
CN 106439672 A 2/2017
(Continued)

OTHER PUBLICATIONS

International Search Report dated Nov. 15, 2019 in corresponding application PCT/EP2019/076612.

*Primary Examiner* — Zheng Song
(74) *Attorney, Agent, or Firm* — Muncy, Geissler, Olds & Lowe, P.C.

(57) ABSTRACT

A headlight for vehicles having a projection module containing a low beam primary lens and a first light source, a high beam primary lens and a second light source, a secondary lens arranged in the main beam direction in front of the low beam primary lens and the high beam primary lens, a secondary lens by means of which, in a low beam mode, in which only the first light source is activated, a first light bundle emitted from the low beam primary lens is mapped according to a specified low beam distribution and, in a high beam mode, in which the first light source and the second light source are activated, the first light bundle is mapped together with the second light bundle emitted from the high beam primary lens in order to produce the high beam distribution, wherein the high beam primary lens has compensator.

6 Claims, 5 Drawing Sheets

(56) References Cited

U.S. PATENT DOCUMENTS

| | | | | |
|---|---|---|---|---|
| 9,285,091 | B2 | 3/2016 | Danner et al. | |
| 9,903,553 | B2 | 2/2018 | Lin et al. | |
| 9,964,272 | B2 | 5/2018 | Lin et al. | |
| 10,094,527 | B1 | 10/2018 | Bushre | |
| 10,168,014 | B2 | 1/2019 | Lee | |
| 10,605,426 | B2 | 3/2020 | Qiu et al. | |
| 10,731,824 | B2 | 8/2020 | Kawai et al. | |
| 2008/0080201 | A1* | 4/2008 | Specht | F21S 41/43 362/507 |
| 2015/0226395 | A1* | 8/2015 | Taudt | F21S 41/153 362/511 |
| 2017/0009950 | A1* | 1/2017 | Lin | F21S 41/322 |
| 2017/0292671 | A1* | 10/2017 | Gousset-Rousseau | F21S 41/143 |
| 2018/0313511 | A1* | 11/2018 | Lee | F21S 41/24 |
| 2019/0226658 | A1* | 7/2019 | Kawai | F21S 41/255 |
| 2020/0003381 | A1* | 1/2020 | Liao | F21S 43/241 |
| 2020/0072428 | A1* | 3/2020 | Simchak | F21S 41/275 |

FOREIGN PATENT DOCUMENTS

| | | | |
|---|---|---|---|
| CN | 108534078 | A | 9/2018 |
| DE | 102010021937 | A1 | 12/2011 |
| DE | 202011103703 | U1 | 12/2011 |
| DE | 202017005367 | U1 | 11/2017 |
| EP | 1903274 | A1 | 3/2008 |
| EP | 3115682 | A1 | 1/2017 |
| WO | WO2018043663 | A1 | 3/2018 |
| WO | WO2018133250 | A1 | 7/2018 |

* cited by examiner

HEADLIGHT FOR VEHICLES

This nonprovisional application is a continuation of International Application No. PCT/EP2019/076612, which was filed on Oct. 1, 2019 and which claims priority to German Patent Application No. 10 2018 125 157.2, which was filed in Germany on Oct. 11, 2018 and which are both herein incorporated by reference.

BACKGROUND OF THE INVENTION

Field of the Invention

The present invention relates to headlight for vehicles having a projection module containing a low beam primary lens and a first light source associated with the same, a high beam primary lens and a second light source associated with the same, a secondary lens arranged in the main beam direction in front of the low beam primary lens and the high beam primary lens, by means of which secondary lens, in a low beam mode, in which only the first light source is activated, a first light bundle emitted from the low beam primary lens is mapped according to a specified low beam distribution and, in a high beam mode, in which the first light source and the second light source are activated, the first light bundle is mapped together with the second light bundle, emitted from the high beam primary lens, in order to produce the high beam distribution.

Description of the Background Art

A headlight for vehicles having a projection module, which has a single secondary lens and two primary lenses associated in each case with the same for producing a low beam and/or high beam distribution, is known from DE 10 2010 021 937 A1, which is incorporated herein by reference. The primary lens has, on the one hand, a low beam primary lens and a first light source associated with the same and, on the other hand, a high beam primary lens and a second light source associated with the same, wherein, by activating the first light source, a first light bundle is mapped by means of the secondary lens formed by a lens, for a low beam light distribution and, when the first and second light sources are activated, a second light bundle is mapped for high beam distribution. There are legal provisions in various countries according to which photometric parameters and discrete measuring locations are specified. For example, there are ECE regulations of the UNECE (United Nations Economic Commission for Europe) or SAE regulations of the US agency NHTSA (National Highway Traffic Safety Administration). The low beam function is evaluated in the ECE R112 by means of discrete illumination levels at locations on a measuring wall at a distance of 25 m. Accordingly, a test point 50 L in the low beam distribution must not exceed an illuminance threshold value. In comparison with an adjacent region, an intensity reduction is therefore necessary at the test point 50 L. A comparable reduction in intensity is required at location 86 D 3.5 L according to the SAE regulation. If the projection module is switched from a low beam mode, meeting the legal requirements for low beam distribution, to a high beam mode by adding the second light sources, the high beam distribution exhibits inhomogeneities in the area of test point 50 L. In the region of this test point, a "dark hole" more or less forms in the high beam distribution. If the headlight has separate modules for low beam and high beam, the compensation of this inhomogeneity for the high beam distribution can be easily offset by appropriate control of the second light source. In the case of a projection module present here, in which the low beam distribution and high beam distribution are produced via a common secondary lens, the problem arises of eliminating these undesirable inhomogeneities in the high beam distribution, which are caused by legal provisions with regard to the low beam distribution, in a simple and effective manner.

SUMMARY OF THE INVENTION

It is therefore an object of the present invention to provide a headlight having a projection module such that inhomogeneities in regions of a high beam distribution, present in a low beam distribution due to legal requirements, are avoided in a simple and effective manner.

To achieve said object, the invention provides an optical face of the low beam primary lens has a recess, so that in the low beam mode, a test point region of the low beam distribution has an illuminance that is lower in comparison to an adjacent region of the same and/or the illuminance in the test point region of the low beam distribution is less than an illuminance threshold value specified by a legal provision and in that the high beam primary lens has a compensator, such that in the high beam mode, a part of the second light bundle is guided so that the test point region of the high beam distribution has an illuminance which is higher in comparison to the low beam mode of the same and/or has the same illuminance as the adjacent region of the high beam distribution.

According to the invention, a low beam primary lens has a recess that is free of a light guide. The region adjoining the recess of the low beam primary lens can be used for light deflection, wherein the light is substantially deflected so that it is mapped by means of the secondary lens in a region adjacent to a test point region. The recess of the low beam primary lens corresponds to the test point region of the low beam distribution. The recess has the effect that part of the light bundle striking the low beam primary lens is not specifically deflected further to the secondary lens, but instead is lost for the use of the secondary lens. In a low beam module, the recess thus enables a "masking" of a light bundle part which strikes the low beam primary lens in a simple manner and would be responsible for illuminating the test point region. In order that the inhomogeneity caused by the reduced illuminance in the test point region is avoided in a high beam mode of the projection module of the invention, the high beam primary lens has a compensator to offset the inhomogeneity arising in the low beam distribution in the test point region, so that a partial light bundle of a second light bundle, which is associated with the high beam primary lens, is guided so that it strikes the test point region and thus leads to an increase in illuminance compared to the low beam mode. In the test point region, there is thus an adjustment of the illuminance to the adjacent regions to approximately the same level as in the test point region. Equal illuminance is understood to mean an illuminance band with a maximum value and a minimum value, within which it is possible to speak of a homogeneous light distribution. The illuminance gradient between the regions within the illuminance band is relatively small, so that it is possible to speak of a homogeneous transition.

The recess of the low beam primary lens can be disposed in an edge region of a lens face of the same and/or on a side of the same lens face, said side facing the high beam primary lens. In this way, the recess can advantageously be produced in a simple manner.

The recess can be formed as a groove which extends from a front edge to a rear edge of the lens face. The front edge and the rear edge delimit a lower edge of the low beam primary lens, which is mapped as a light/dark boundary of the light distribution. The test point region in the low beam light distribution can advantageously be addressed thereby in a simple manner, so that a significant reduction in brightness/intensity takes place in the test point region.

The high beam primary lens can have a projection on a side facing the low beam primary lens. The projection forms, so to speak, an extension of a light guide, receiving the second light bundle, of the high beam primary lens. Advantageously, such a portion of the light strikes the projection that otherwise could not be used for the high beam distribution in the absence of the projection. By an appropriate design of the projection, the illuminance dip in the test point region can be raised or eliminated, so that there are no inhomogeneities or significant illuminance levels different between the test point region and the adjacent region in the high beam distribution.

The projection can be formed as a spring which preferably engages precisely in a groove in the low beam primary lens. The high beam primary lens is positively connected to the low beam primary lens via the projection, wherein a relative transverse displacement between the low beam primary lens and the high beam primary lens transverse to a main beam direction and transverse to a vertical plane is prevented. Because a light feed of the high beam primary lens occurs on a side facing away from the light exit side of the projection, only part of the second light bundle, which is emitted by the second light source associated with the high beam primary lens, can pass through the projection.

The projection of the high beam primary lens can be disposed at a distance from the recess of the low beam primary lens, wherein a light exit face of the projection is formed such that the light, guided through the projection and exiting on the light exit face, is taken in the direction of the recess of the low beam primary lens. In this way, the space provided by the recess is used for the test point region luminous flux additionally determined in the high beam mode. The projection thus forms an extension of the high beam primary lens, which is provided to additionally illuminate the test point region, so that inhomogeneities with the adjacent region of the high beam distribution are avoided.

The projection can be disposed on a single light finger of a plurality of light fingers, wherein the light fingers converge to form a common light exit face of the high beam primary lens. The second light source, by means of which the second light bundle is emitted, is disposed in each case at a free end of the light fingers. The light fingers advantageously enable a specific light guidance from a plurality of light sources to the common light exit face of the high beam primary lens, so that the specified high beam distribution can be produced by superimposition with the first light bundle emitted by the low beam primary lens.

The high beam primary lens can be arranged below the low beam primary lens, wherein a lower edge of the low beam primary lens rests on an upper edge of the high beam primary lens. The high beam primary lens and the low beam primary lens are preferably arranged in a planar manner against one another, so that they form a common primary lens module. The primary lens can thus advantageously be disposed in a space-saving manner.

The secondary lens can be designed as a single lens through which the first light bundle emitted by the low beam primary lens and the second light bundle emitted by the high beam primary lens are deflected so that the corresponding low beam distribution or high beam distribution is produced. The projection module thus has a compact structure.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
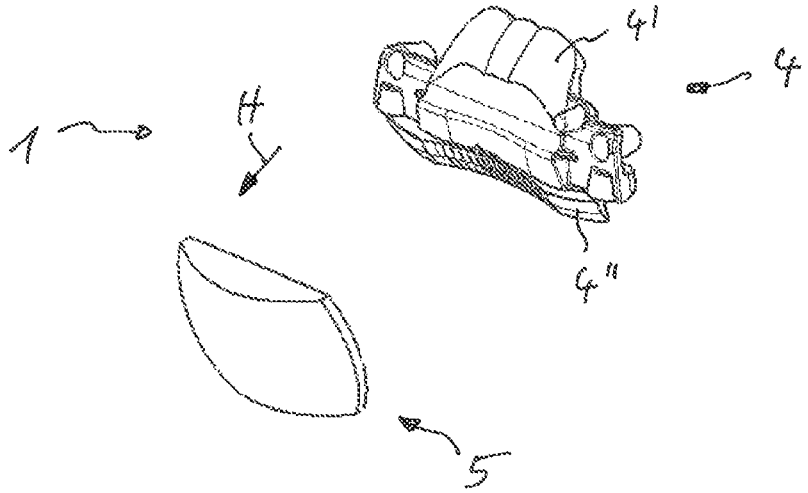
FIG. 1 shows a perspective illustration of a projection module.
Figure 2:
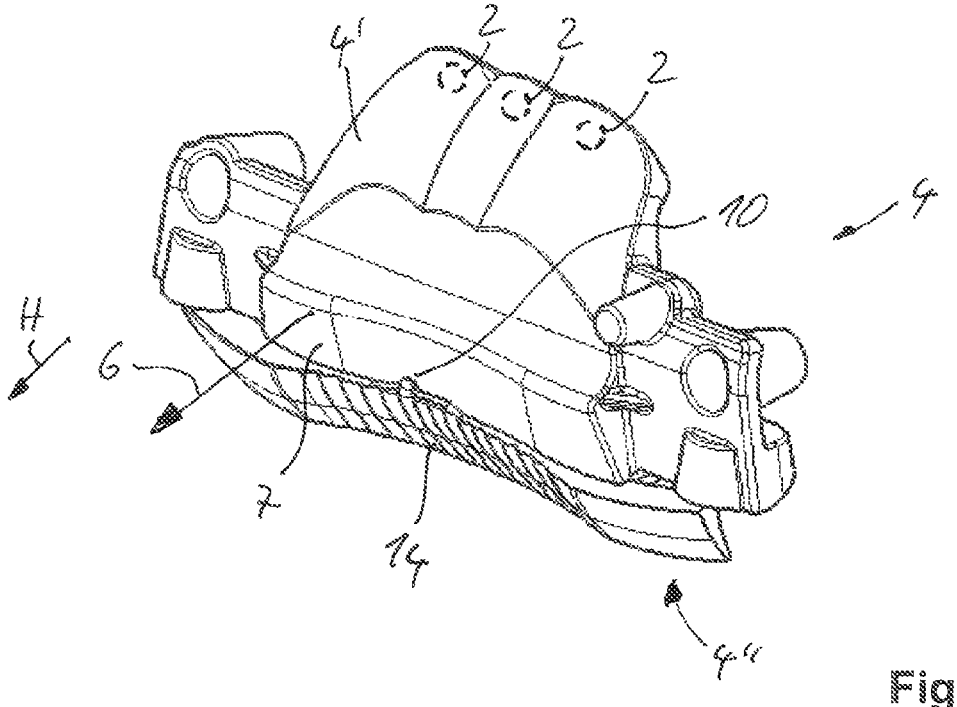
FIG. 2 shows an enlarged illustration of a primary lens of the projection module.

A headlight of the invention for vehicles is designed as a projection module 1 which is disposed within a headlight housing. The headlight housing is usually closed by a crystal-clear cover plate. Projection module 1 has a plurality of light sources 2, 3, which are shown schematically and only by way of example by a circle in the figures. Light sources 2, 3 are associated with a primary lens 4, which transforms the light emitted by light sources 2, 3 so that it strikes secondary lens 5, by means of which the light is mapped to the specified low beam distribution AL or high beam distribution FL.

Primary lens 4 has, on the one hand, a low beam primary lens 4' with which a first light source 2 is associated. Low beam primary lens 4' has a one-piece optical element, on the edge sides of which first light bundle 6 emitted by first light source 2 is deflected repeatedly before it exits on a front lens face 7 in the main beam direction H or in the direction of secondary lens 5 designed as a projection lens. Low beam primary lens 4' has a plurality of lens segments, each of which is associated with a separate first light source 2.

A recess 10 is provided on a lower edge 9 of low beam primary lens 4' or the front lens face 7. In comparison to a conventional low beam primary lens 4' without a recess 10, front lens face 7 and thus the light exit face of low beam primary lens 4' are reduced. Recess 10 is located in such an area of front lens face 7 of low beam primary lens 4' that corresponds to a test point region X in the low beam light distribution AL. According to legal requirements, this test point region X must have a lower illuminance than an adjacent region N of the low beam distribution AL. The test point region X is the test point 50 L, which must not exceed a specified illuminance threshold value according to an ECE regulation. This is therefore a matter of a local decrease in intensity or decrease in brightness in the test point region X. The requirements with regard to the legal provisions with respect to the production of the low beam distribution AL can thus be met. A light component of first light bundle 6, which would essentially be responsible for the illumination of the test point region X, is "masked" or not made available to secondary lens 5 due to the presence of recess 10. In the mapping plane of secondary lens 5, there is no light due to recess 10, so that a "hole" forms in the low beam distribution AL.

Recess 10 is designed as a groove which extends from a front edge 11 of lens face 7 to a rear edge 12 of the same lens face 7. Front edge 11 and rear edge 12 delimit lower edge 9 of low beam primary lens 4', which is mapped as a light/dark boundary of the low beam distribution AL.

The low beam distribution AL is produced in the low beam mode, wherein only first light sources 2 are activated. Second light sources 3 are deactivated. First light bundle 6 emitted by first light sources 2 is emitted solely by low beam primary lens 4' in the direction of secondary lens 5.

In a high beam mode, a high beam distribution FL is produced in which first light sources 2 and second light sources 3 are activated. Whereas first light bundle 6 is made available to secondary lens 5 by means of low beam primary lens 4', a second light bundle 13 emitted by second light sources 3 is made available to secondary lens 5 via high beam primary lens 4". High beam primary lens 4" is arranged below low beam primary lens 4. It has a front lens face 14 (common light exit face) from which a plurality of light-guiding light fingers 15 protrude counter to the main beam direction H. Second light sources 3 are each arranged at the free ends of light fingers 15. Front lens face 14 has a plurality of segments 14' at which second light bundle 13 is emitted so that it is mapped together with first light bundle 6 by secondary lens 5 according to the high beam distribution FL. So that the illumination dip in the test point region X is compensated, high beam primary lens 4" has a projection 16 as a compensator, which is designed so that a part 13' of second light bundle 13 is mapped to the test point region X by means of secondary lens 5. In the mapping plane of secondary lens 5, there is additional light in the area of recess 10 compared to the low beam mode. In the high beam mode, this light is mapped onto the road by secondary lens 5, so that the "hole" is closed.

Figure 3:
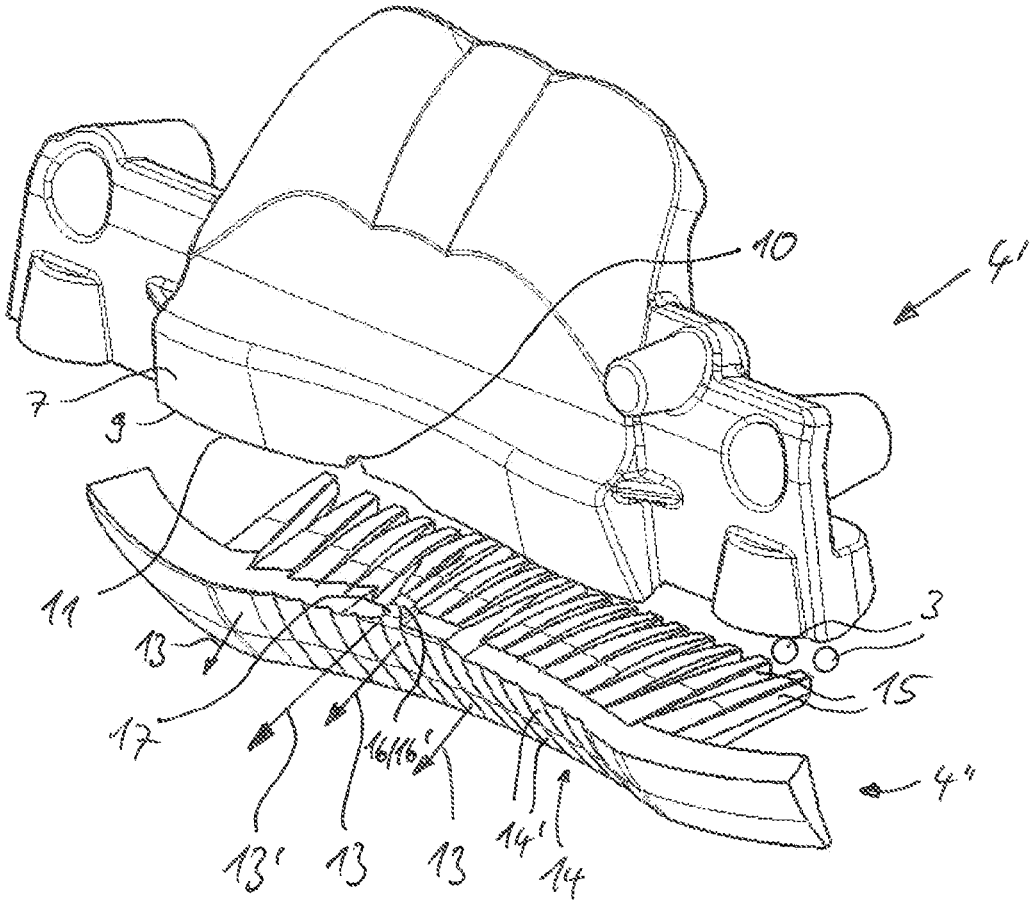
FIG. 3 shows an exploded illustration of a low beam primary lens and a high beam primary lens of the primary lens according to a first embodiment of the invention.

Projection 16 is preferably associated with a light finger 15 or forms an extension or a lateral bulge of this light finger 15. Projection 16 has a light exit face 17 which, according to a first exemplary embodiment of the invention according to FIG. 3, continuously or differentially continuously adjoins front face 14 or segments 14'. Projection 16 extends here as a spring 16', which is arranged precisely in recess 10 of low beam primary lens 4. As a result, low beam primary lens 4' is connected positively to high beam primary lens 4" transverse to the main beam direction H.

Figure 6A:
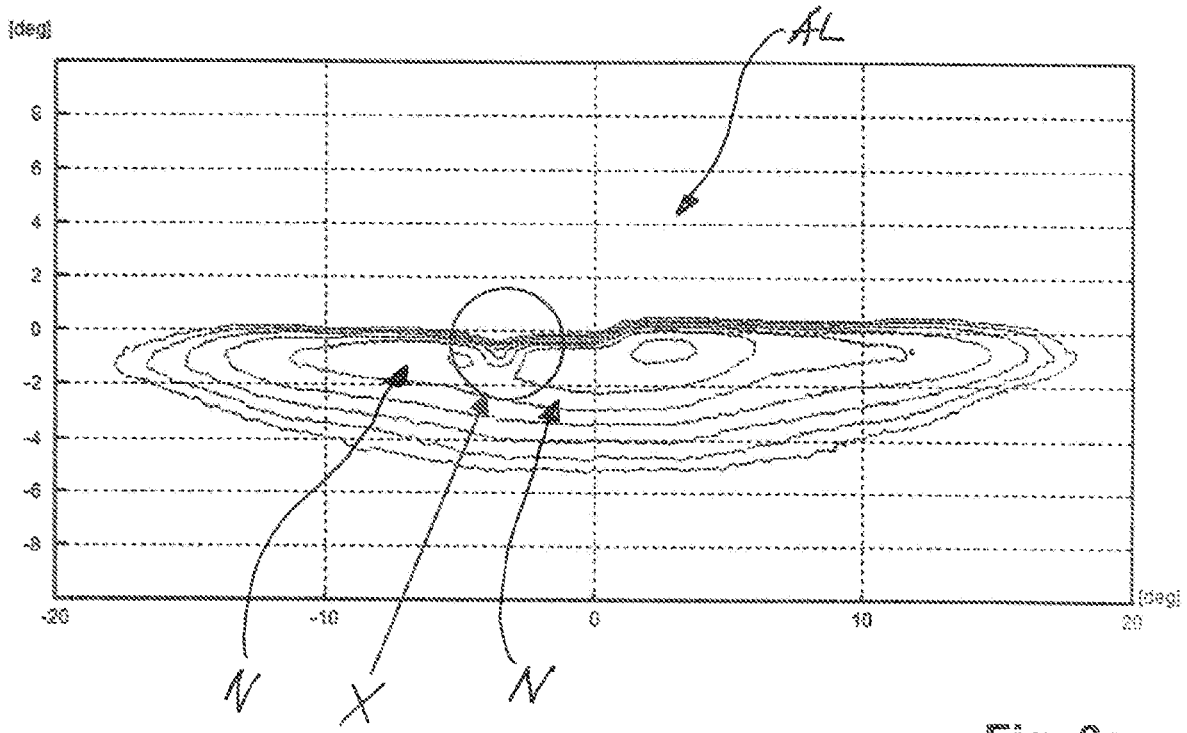
FIG. 6*a* shows a low beam distribution of the projection module with an illumination dip in a test point region X.
Figure 6B:
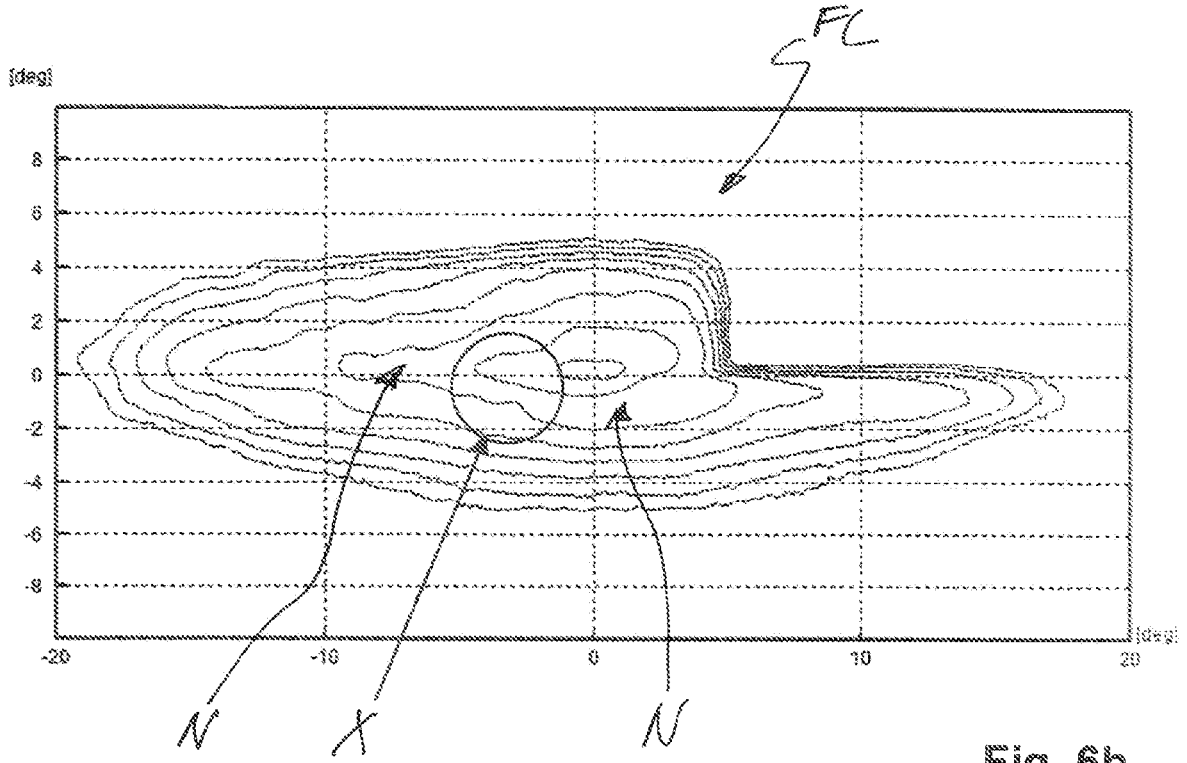
FIG. 6*b* shows a high beam distribution of the projection module of the invention with the compensator in the test point region X.
Figure 6C:
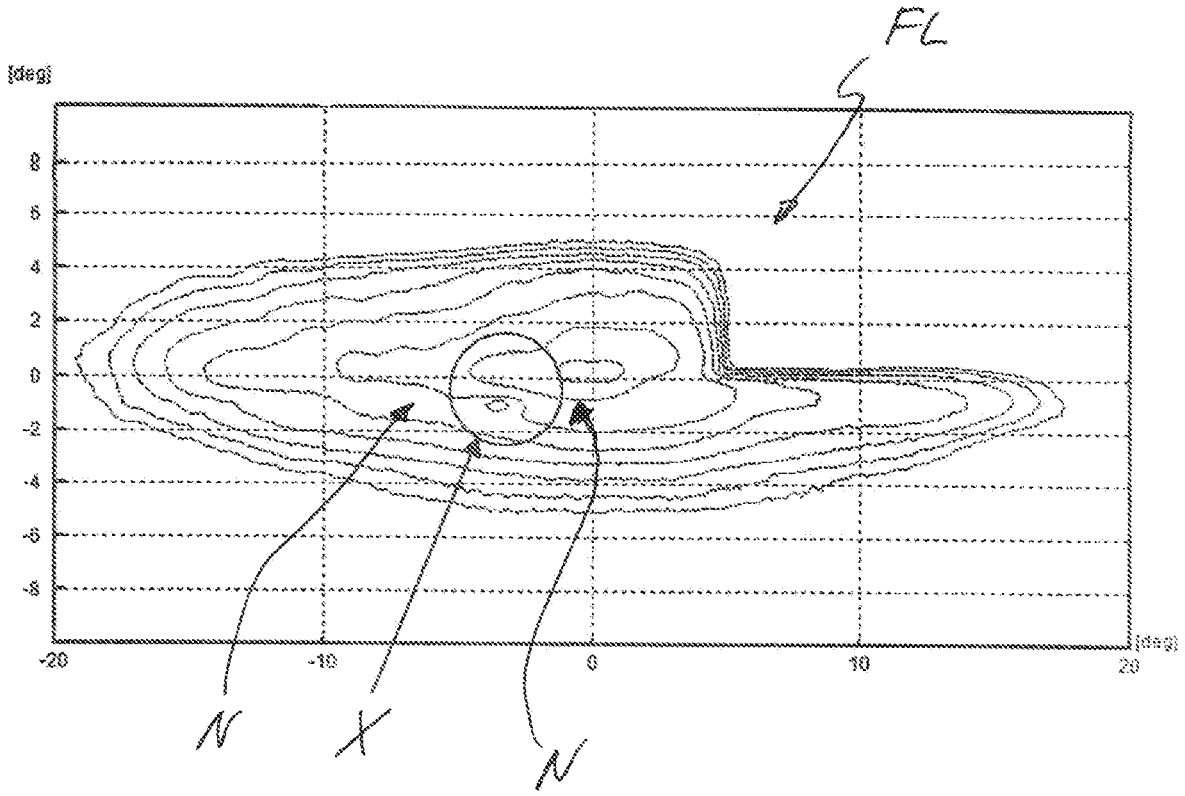
FIG. 6*c* shows a high beam distribution of the projection module without a compensator of the invention for the test point region X.

As can be seen from FIG. 6*b*, a homogeneous transition from the test point region X to the adjacent region N of the high beam distribution FL can be achieved hereby. Without the presence of projection 16, a high beam distribution 18 in the test point region X would have an illuminance dip or intensity reduction (dark area).

Figure 4:
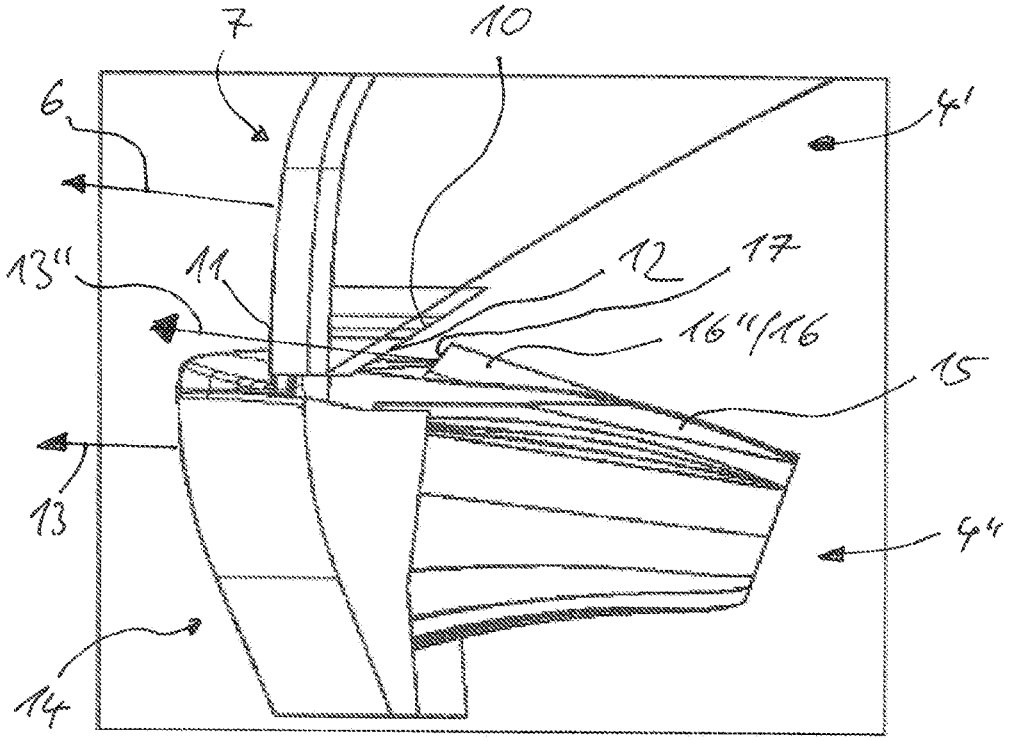
FIG. 4 shows a side illustration of the primary lens according to a second embodiment of the invention.
Figure 5:
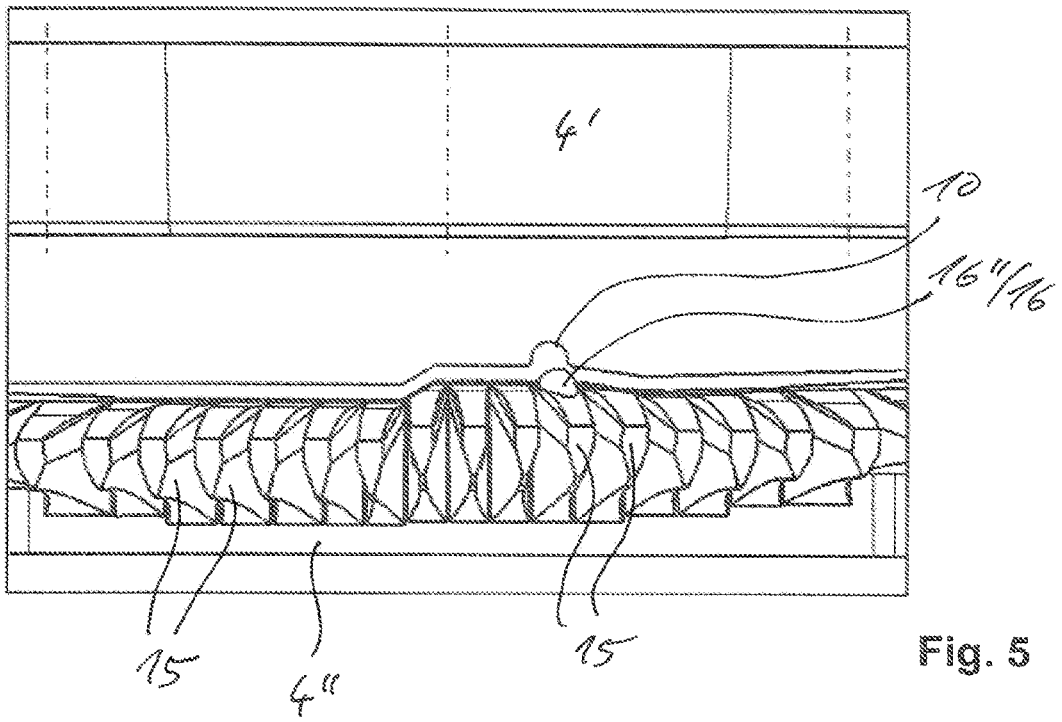
FIG. 5 shows a rear view of the primary lens according to FIG. 4.

According to an alternative embodiment of the invention, according to FIGS. 4 and 5, a projection 16" can also be formed on light finger 15 so that light exit face 17 of projection 16" is disposed at a distance from recess 10 of low beam primary lens 4'. Projection 16' is shaped or light exit face 17 of the same is formed such that part 13" of second light bundle 13, said part exiting through light exit face 17, exits through recess 10 from primary lens 4 and strikes secondary lens 5. The recess or groove 10 of low beam primary lens 4' is "illuminated", so to speak, from behind by means of projection 16".

The same components or component functions of the exemplary embodiments are provided with the same reference characters.

Lower edge 9 of low beam primary lens 4' rests on an upper edge of high beam primary lens (4"), preferably in a planar manner.

The invention thus uses recess 10, required to maintain the photometric measured values of the low beam distribution AL, for light emission or transmission of a light bundle part 13" of high beam primary lens 4" in order to increase the illuminance in the test point region X.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A headlight for vehicles having a projection module, the headlight comprising:

a low beam primary lens;

a first light source associated with the low beam primary lens, a high beam primary lens;

a second light source associated with the high beam primary lens;

a secondary lens arranged in a main beam direction in front of the low beam primary lens and the high beam primary lens, wherein, in a low beam mode in which only the first light source is activated, a first light bundle emitted from the low beam primary lens is mapped via the secondary lens according to a specified low beam distribution and, in a high beam mode in which the first light source and the second light source are activated, the first light bundle is mapped together with a second light bundle emitted from the high beam primary lens in order to produce a high beam distribution; and a lens face of the low beam primary lens having a recess, so that in the low beam mode, a test point region of the low beam distribution has a reduced illuminance compared to an adjacent region of the low beam distribution and/or an illuminance in the test point region of the low beam distribution is less than an illuminance threshold value specified by a legal provision, wherein the high beam primary lens has a compensator such that, in the high beam mode, a part of the second light bundle is guided by the compensator so that a test point region of the high beam distribution has an illuminance which is higher in comparison to the test point region of the low beam mode and/or the test point region of the high beam distribution has the same illuminance as an adjacent region of the high beam distribution, wherein the compensator of the high beam primary lens is formed as a projection disposed on a side facing the low beam primary lens, wherein the projection of the high beam primary lens engages in the recess of the low beam primary lens, wherein the recess is formed as a groove and wherein the projection is formed as a spring, which engages precisely in the groove of the low beam primary lens.

2. The headlight according to claim 1, wherein the recess of the low beam primary lens is disposed at a lower edge of the lens face, the edge forming a light/dark boundary, and/or the recess is disposed on a side of the lens face, the side facing the high beam primary lens.

3. The headlight according to claim 1, wherein the recess is formed as a groove which extends from a front edge of the lens face to a rear edge of the the lens face.

4. The headlight according to claim 1, wherein the high beam primary lens is disposed below the low beam primary lens, wherein a lower edge of the low beam primary lens rests on an upper edge of the high beam primary lens.

5. A headlight for vehicles having a projection module, the headlight comprising:

a low beam primary lens;

a first light source associated with the low beam primary lens, a high beam primary lens;

a second light source associated with the high beam primary lens;

a secondary lens arranged in a main beam direction in front of the low beam primary lens and the high beam primary lens, wherein, in a low beam mode in which only the first light source is activated, a first light bundle emitted from the low beam primary lens is mapped via the secondary lens according to a specified low beam distribution and, in a high beam mode in which the first light source and the second light source are activated, the first light bundle is mapped together with a second light bundle emitted from the high beam primary lens in order to produce a high beam distribution; and a lens face of the low beam primary lens having a recess, so that in the low beam mode, a test point region of the low beam distribution has a reduced illuminance compared to an adjacent region of the low beam distribution and/or an illuminance in the test point region of the low beam distribution is less than an illuminance threshold value specified by a legal provision, wherein the high beam primary lens has a compensator such that, in the high beam mode, a part of the second light bundle is guided by the compensator so that a test point region of the high beam distribution has an illuminance which is higher in comparison to the test point region of the low beam mode and/or the test point region of the high beam distribution has the same illuminance as an adjacent region of the high beam distribution, wherein the compensator of the high beam primary lens is formed as a projection disposed on a side facing the low beam primary lens, and wherein the projection is disposed at a distance to the recess, wherein a light exit face of the projection is formed such that the part of the second light bundle, the part guided through the projection, exits at the light exit face in a direction of the recess.

6. A headlight for vehicles having a projection module, the headlight comprising:

a low beam primary lens;

a first light source associated with the low beam primary lens, a high beam primary lens;

a second light source associated with the high beam primary lens;

a secondary lens arranged in a main beam direction in front of the low beam primary lens and the high beam primary lens, wherein, in a low beam mode in which only the first light source is activated, a first light bundle emitted from the low beam primary lens is mapped via the secondary lens according to a specified low beam distribution and, in a high beam mode in which the first light source and the second light source are activated, the first light bundle is mapped together with a second light bundle emitted from the high beam primary lens in order to produce a high beam distribution; and a lens face of the low beam primary lens having a recess, so that in the low beam mode, a test point region of the low beam distribution has a reduced illuminance compared to an adjacent region of the low beam distribution and/or an illuminance in the test point region of the low beam distribution is less than an illuminance threshold value specified by a legal provision, wherein the high beam primary lens has a compensator such that, in the high beam mode, a part of the second light bundle is guided by the compensator so that a test point region of the high beam distribution has an illuminance which is higher in comparison to the test point region of the low beam mode and/or the test point region of the high beam distribution has the same illuminance as an adjacent region of the high beam distribution, wherein the compensator of the high beam primary lens is formed as a projection disposed on a side facing the low beam primary lens, and wherein the high beam primary lens has a plurality of light fingers, wherein the projection is disposed on a single one of the light fingers and the light fingers converge to form a common lens face of the high beam primary lens, and wherein the second light source is disposed at a free end of the light fingers.

* * * * *